US006183240B1

(12) United States Patent
Döbbeling et al.

(10) Patent No.: US 6,183,240 B1
(45) Date of Patent: Feb. 6, 2001

(54) BURNER

(75) Inventors: Klaus Döbbeling, Windisch (CH); Ephraim Gutmark, Baton Rouge, LA (US); Christian Oliver Paschereit, Baden; Wolfgang Weisenstein, Remetschwil, both of (CH)

(73) Assignee: ABB Research Ltd., Zurich (CH)

( * ) Notice: Under 35 U.S.C. 154(b), the term of this patent shall be extended for 0 days.

(21) Appl. No.: 09/438,588

(22) Filed: Nov. 12, 1999

(30) Foreign Application Priority Data

Nov. 18, 1998 (EP) ..... 98811144

(51) Int. Cl.[7] ..... F24C 6/04

(52) U.S. Cl. ..... 431/10; 431/8; 431/351; 431/353

(58) Field of Search ..... 431/8, 10, 350–354, 431/173, 284, 174, 285; 60/737, 748

(56) References Cited

U.S. PATENT DOCUMENTS 3,879,939 4/1975 Markowski .
4,054,028 * 10/1977 Kawaguchi ..... 431/353
4,257,224 3/1981 Wygnanski et al. .
5,169,302 12/1992 Keller .
5,375,995 12/1994 Dobbeling et al. .
5,453,004 * 9/1995 Hofbauer ..... 431/9
5,961,313 * 10/1999 Haumann et al. ..... 431/353

FOREIGN PATENT DOCUMENTS

0866268A1 9/1998 (EP) .

* cited by examiner

*Primary Examiner*—James C. Yeung
(74) *Attorney, Agent, or Firm*—Burns, Doane, Swecker & Mathis, L.L.P.

(57) ABSTRACT

A burner for operating a unit for generating a hot gas consists essentially of at least two hollow partial bodies (1, 2) which are interleaved in the flow direction and whose center lines extend offset relative to one another in such a way that adjacent walls of the partial bodies (1,2) form tangential air inlet ducts (5, 6) for the inlet flow of combustion air (7) into an internal space (8) prescribed by the partial bodies (1, 2). The burner has at least one fuel nozzle (11). In order to control flow instabilities in the burner, the inside of the burner outlet (17) has a plurality of nozzles (32) along the periphery of the burner outlet (17) for introducing axial vorticity into the flow, the nozzles (32) for injecting air (34) being arranged at an angle to the flow direction (30).

18 Claims, 2 Drawing Sheets

BURNER

FIELD OF THE INVENTION

The invention relates to a burner for operating a unit for generating a hot gas.

BACKGROUND OF THE INVENTION

Thermoacoustic vibrations represent a danger for every type of combustion application. They lead to high-amplitude pressure fluctuations, to a limitation in the operating range and they can increase the emissions associated with the combustion. These problems occur particularly in combustion systems with low acoustic damping, such as are often presented by modern gas turbines.

In conventional combustion chambers, the cooling air flowing into the combustion chamber acts to dampen noise and therefore contributes to the damping of thermoacoustic vibrations. In order to achieve low $NO_x$ emissions, an increasing proportion of the air is passed through the burner itself in modern gas turbines and the cooling air flow is reduced. Because of the associated lower level of noise damping, the problems discussed at the beginning correspondingly occur to an increased extent in modern combustion chambers.

One noise-damping possibility consists in the coupling of Helmholtz dampers in the combustion chamber dome or in the region of the cooling air supply. In the case of restricted space relationships, which are typical of modern, compact designs of combustion chambers, however, the accommodation of such dampers can introduce difficulties and is associated with a large measure of design complication.

A further possibility consists in controlling thermoacoustic vibrations by active acoustic excitation. In this procedure, the shear layer which forms in the region of the burner is acoustically excited. A suitable phase lag between the thermoacoustic vibrations and the excitation makes it possible to achieve damping of the combustion chamber vibrations. Such a solution does, however, require the installation of additional elements in the region of the combustion chamber.

It is similarly suitable to modulate the fuel mass flow. In this procedure, fuel is injected into the burner with a phase shift relative to measured signals in the combustion chamber (for example, relative to the pressure) so that additional heat is released at a pressure minimum. This reduces the amplitude of the pressure vibrations.

SUMMARY OF THE INVENTION

This forms the basis for the invention. The invention, is based on the object of creating an appliance which permits effective suppression of thermoacoustic vibrations and is associated with the smallest possible design complication. This object is achieved according to the invention by the burner of the invention.

Coherent structures play a decisive role in mixing processes between air and fuel. The spatial and temporal dynamics of these structures influence the combustion and the release of heat. The invention is based on the idea of perturbing the formation of coherent vortex structures in order, by this means, to reduce the periodic fluctuation in the release of heat and, in consequence, to reduce the amplitude of the thermoacoustic fluctuations.

A burner according to the invention for operating a unit for generating a hot gas consists essentially of at least two hollow partial bodies which are interleaved in the flow direction and whose centre lines extend offset relative to one another in such a way that adjacent walls of the partial bodies form tangential air inlet ducts for the inlet flow of combustion air into an internal space prescribed by the partial bodies. The burner has at least one fuel nozzle. In order to control flow instabilities in the burner, the inside of the burner outlet has a plurality of nozzles along the periphery of the burner outlet for introducing axial vorticity into the flow, the nozzles for injecting air being arranged at an angle to the flow direction.

The invention is therefore based on the idea of perturbing the formation of coherent vortex structures by the introduction of vorticity in the axial direction. In a burner of the generic type, the vorticity is introduced, in accordance with the invention, by air being injected at an angle to the flow direction via a plurality of nozzles. These nozzles are then provided as close as possible to the burner outlet so that their effect can develop as fully as possible.

The relative position of flow direction and injection direction of the air can be completely described by two angles $\phi$, $\alpha$ (FIGS. 2, 3). $\phi$ then represents the angle between the injection direction of the air and a plane at right angles to the flow direction and $\alpha$ represents the angle between the injection direction of the air and the direction pointing radially towards the centre line. The nozzles are advantageously arranged in such a way that $\phi$ is between −45° and +45°, preferably between −20° and +20°, particularly preferably at approximately 0°. $\alpha$ is advantageously between −45° and +45°, preferably between −20° and +20°, particularly preferably at approximately 0°. In a particularly preferred embodiment, $\phi$ and $\alpha$ are each approximately 0° and the injection of the air therefore takes place in a plane at right angles to the flow direction, radially inwards towards the centre line.

The cross section of the nozzles is arbitrary but an elliptical, in particular a circular, cross section is preferred. The nozzles can be advantageously arranged along the periphery of the burner outlet in a plurality of rows and not in one row only.

The flow instabilities in the burner mostly have a dominant mode. The damping of this dominant mode is a priority requirement for the suppression of thermoacoustic vibrations. The wavelength $\lambda$ of the dominant mode of the instability is derived from its frequency f and the convection velocity $u_c$ by means of $\lambda = u_c/f$. The relevant frequencies lie between some 10 Hz and some kHz. The convection velocity depends on the burner and is typically some 10 m/s, for example 30 m/s.

Now, it has been found that the dominant mode is suppressed particularly effectively if the distances s between adjacent nozzles along the periphery of the burner outlet are smaller than or approximately equal to half the wavelength of the dominant mode, i.e. s.

Furthermore, particularly effective suppression has been found when the maximum diameter D of the nozzles is greater than approximately a quarter of the boundary layer thickness $\delta$ in the region of the nozzles. In the case of elliptical nozzles, the maximum diameter is twice the major semiaxis and, in the case of circular nozzles, twice the radius. For a typical burner, the boundary layer thickness is approximately 1 mm.

It has also been found to be advantageous for the maximum diameter D of the nozzles to be smaller than approximately a fifth of the distance s between adjacent nozzles. Although significant suppression of the thermoacoustic vibrations is achieved when only one of the three conditions quoted is satisfied, a particularly preferred embodiment satisfies all the conditions simultaneously.

If required by the boundary conditions, such as the air mass flow present or the space available, the distances and the diameters of the nozzles can also, however, be adapted to these boundary conditions.

The introduction, in accordance with the invention, of vorticity in the axial direction to perturb coherent vortex structures by injecting air at an angle to the flow direction is applicable not only in the case of the double-cone burner described here but also in the case of other types of burner.

Further advantageous embodiments, features and details of the invention are given by the dependent claims, the description of the embodiment examples and the drawings. The invention is explained in more detail below using an embodiment example in association with the drawings. Only the elements essential to understanding the invention are presented in each case. In the drawings

DETAILED DESCRIPTION OF THE INVENTION

Figure 1:
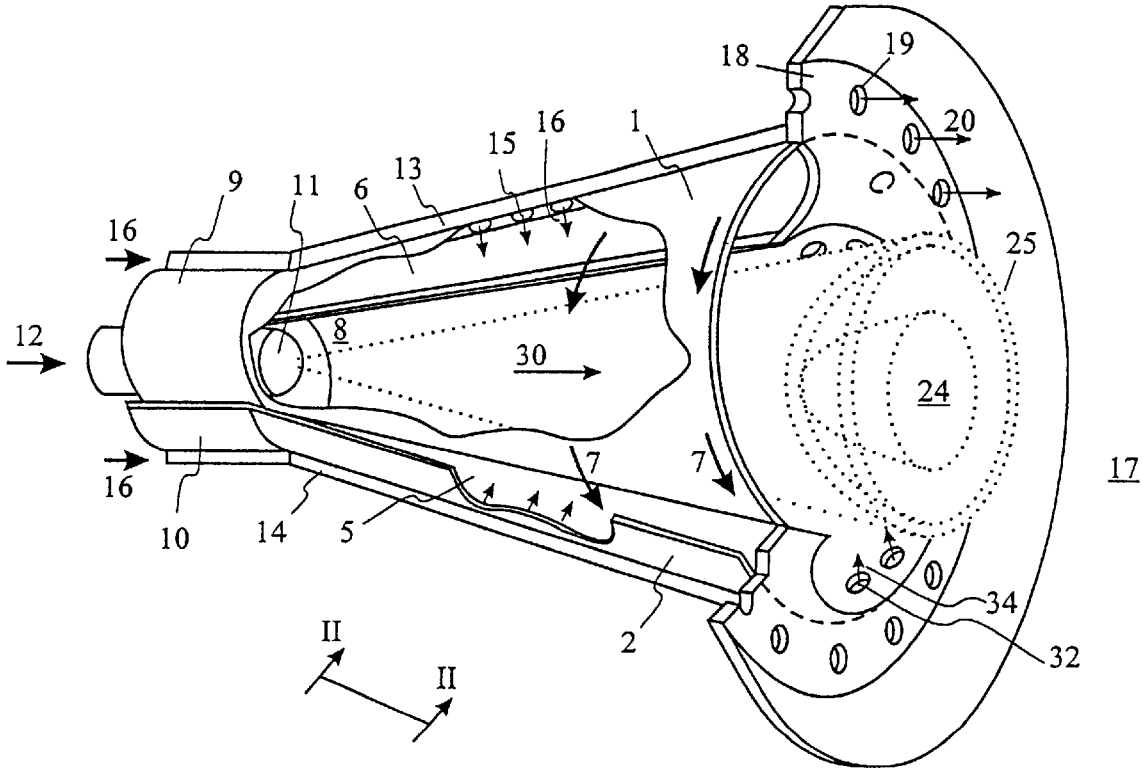
FIG. 1 shows an embodiment example of a burner, in accordance with the invention, in perspective representation and appropriately cut open.

FIG. 1 shows a burner, in accordance with the invention, which consists of two partial hollow semi-conical bodies 1, 2 which are arranged offset relative to one another. The offset of the respective centre lines of the partial conical bodies 1, 2 relative to one another creates a respective tangential air inlet duct 5, 6 on each side, in a mirror-image arrangement. The combustion air 7 flows through these tangential air inlet ducts into the internal space 8 of the burner. The partial conical bodies 1, 2 have cylindrical initial parts 9, 10 which contain a fuel nozzle 11 through which the liquid fuel 12 is injected. In addition, the partial conical bodies 1, 2 each have, if required, a fuel conduit 13, 14, which conduits are provided with openings 15 through which gaseous fuel 16 is admixed to the combustion air 7 flowing through the tangential air inlet ducts 5, 6.

At the combustion space end 17, the burner has a collar-shaped front plate 18, which is used to anchor the semi-conical bodies 1, 2 and which has a number of holes 19 through which, if required, dilution air or cooling air 20 can be supplied to the front part of the combustion space or to its wall.

The fuel injection arrangement can involve an air-blast nozzle or a nozzle operating on the pressure atomization principle. The conical spray pattern is enclosed by the tangentially entering combustion air flows 7. The concentration of the injected fuel 12 is continuously reduced in the flow direction 30 by the combustion air flows 7. If a gaseous fuel 16 is introduced in the region of the tangential air inlet ducts 5, 6, the formation of the mixture with the combustion air 7 has already commenced in this region. When a liquid fuel 12 is used, the optimum, homogeneous fuel concentration over the cross section is reached in the region of the vortex collapse, i.e. in the region of the reverse flow zone 24 at the end of the premixing burner. The ignition of the fuel/combustion air mixture begins at the tip of the reverse flow zone 24. It is only at this location that a stable flame front 25 can occur.

Figure 2:
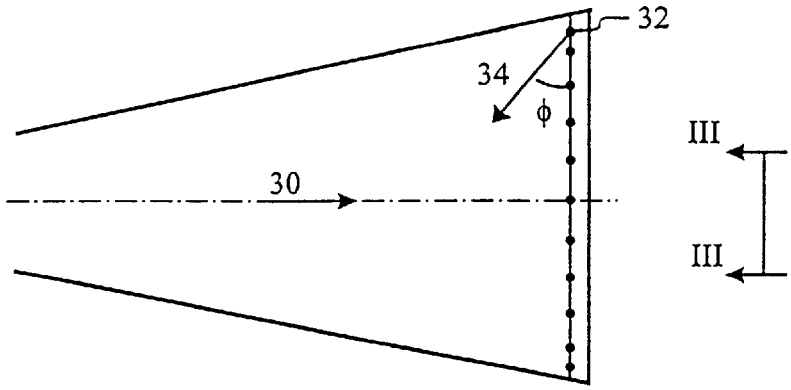
FIG. 2 shows a diagrammatic side view of a burner in accordance with the invention in the direction II—II in FIG. 1.
Figure 3:
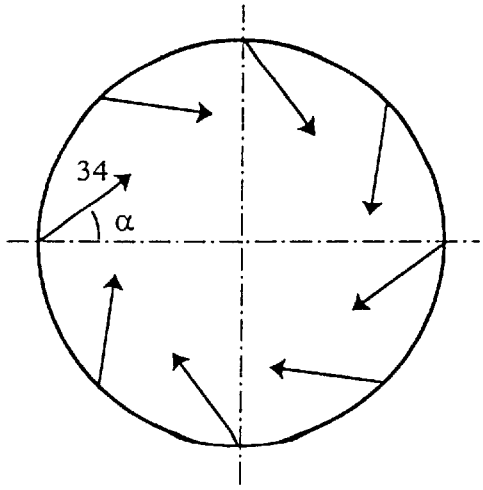
FIG. 3 shows a diagrammatic front view of a burner in accordance with the invention in the direction III—III in FIG. 2.
Figure 4:
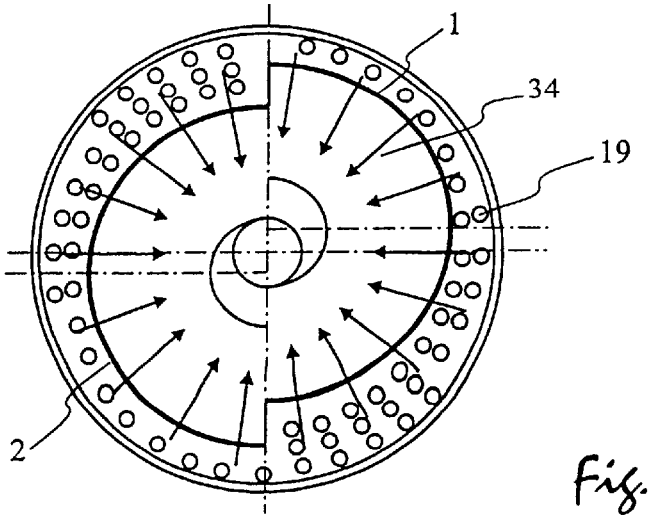
FIG. 4 shows a front view of an embodiment example of a burner in accordance with the invention.

A plurality of nozzles 32 of circular cross section are arranged on the inside of the burner outlet 17. Air 34 is injected through the nozzles 32 at right angles to the flow direction 30 in a plane at right angles to the flow direction. FIGS. 2 and 3 show the definitions of the angles $\phi$ and $\alpha$, by means of which the relative position of the flow direction and the injection direction can be completely described. In this arrangement, $\phi$ represents the angle between the injection direction of the air and a plane at right angles to the flow direction and $\alpha$ represents the angle between the injection direction of the air and the direction pointing radially inwards towards the centre line. FIG. 4 shows an embodiment example of a burner in accordance with the invention in which $\phi$ and $\alpha$ are respectively approximately 0°. The flow direction of the perturbation air 34 emerging from the nozzles 32 (not shown in FIG. 4) points radially inwards in this embodiment example. Although this invention has been illustrated and described in accordance with certain preferred embodiments, it is recognized that the scope of this invention is to be determined by the following claims.

What is claimed is:

1. A burner for operating a unit for generating a hot gas, the burner comprising:

at least two hollow partial bodies which are interleaved in a direction of flow and whose center lines extend offset relative to one another, such that adjacent walls of the partial bodies form tangential air inlet ducts for the inlet flow of combustion air into an internal space prescribed by the partial bodies, and the burner having at least one fuel nozzle and a burner outlet having an inside, wherein, in order to control flow instabilities in the burner, the inside of the burner outlet has a plurality of nozzles along the periphery of the burner outlet for introducing axial vorticity into the flow, the nozzles for injecting air being arranged at an angle to the flow direction.

2. The burner according to claim 1, in which the cross section of the nozzles is elliptical.

3. The burner according to claim 2, in which the cross section of the nozzles is circular.

4. The burner according to claim 1, in which the angle between the flow direction and the injection direction of the air is given by angles ($\phi$, $\alpha$), where the angle $\phi$ represents the angle between the injection direction of the air and a plane at right angles to the flow direction, where the angle $\alpha$ represents the angle between the injection direction of the air and the direction pointing radially inwards towards the respective center line, and where the nozzles are arranged such that the angle $\phi$ is between −45° and +45°, and the angle $\alpha$ is between −45° and +45°.

5. The burner according to claim 4, wherein the nozzles are arranged such that the angle $\phi$ is between −20° and +20°, and the angle $\alpha$ is between −20° and +20 °.

6. The burner according to claim 4, wherein the nozzles are arranged such that the angle $\phi$ is approximately 0°, and the angle $\alpha$ is approximately 0°.

7. The burner according to claim 1, wherein the nozzles are arranged in a plurality of rows along the periphery of the burner outlet.

8. The burner according to claim 1, wherein the flow instabilities have a dominant mode, which includes a wavelength; and the distances between adjacent nozzles along the periphery of the burner outlet are smaller than or approximately equal to half the wavelength of the dominant mode.

9. The burner according to claim 1, wherein the nozzles have a maximum diameter which is greater than approximately a quarter of a boundary layer thickness in the region of the nozzles.

10. The burner according to claim 1, wherein the nozzles have a maximum diameter which is smaller than approximately a fifth of the distance between adjacent nozzles.

11. A method of operating a burner comprising the steps of:

introducing air into the burner along at least a part of the burner in a mainly tangential direction thereby generating a swirl flow within the burner;

introducing fuel into said swirl flow in a mainly axial direction;

mixing said fuel and said air by means of said swirl flow; and near the burner outlet continuously introducing axial vorticity into the swirl flow by means of injecting additional air mainly radially into the swirl flow in order to control flow instabilities within the burner.

12. The method according to claim 11, wherein said additional air is injected into the burner by angles $\phi$ and $\alpha$, angle $\phi$ representing the angle between the injection direction of the additional air and a plane at right angles to the flow direction and angle $\alpha$ representing the angle between the injection direction of the additional air and the direction pointing radially inwards towards the respective centre line, the angle $\phi$ being between $-45°$ and $+45°$, preferably between $-20°$ and $+20°$, in particular preferably at approximately 0°; and the angle $\alpha$ being between $-45°$ and $+45°$, preferably between $-20°$ and $+20°$, in particular preferably at approximately 0°.

13. The method according to claim 12, wherein the angle $\phi$ is between $-20°$ and $+20°$, and the angle $\alpha$ is between $-20°$ and $+20°$.

14. The method according to claim 12, wherein the angle $\phi$ is approximately 0°, and the angle $\alpha$ is approximately 0°.

15. The method according to claim 11, wherein said additional air is injected into the burner as several distinct jets in a preferably equidistant distribution around the circumference of the burner.

16. The method according to claim 15, wherein said jets are spaced apart from each other by a distance which is equivalent or smaller than half of a wave length of a dominant mode of the flow instabilities.

17. The method according to claim 15, wherein said jets have a diameter which is greater than a quarter of a boundary layer forming at the burner walls at the axial position of the jet injection.

18. The method according to claim 17, wherein said jets have a diameter which is smaller than one fifth of the distance between two jets.

* * * * *

UNITED STATES PATENT AND TRADEMARK OFFICE

CERTIFICATE OF CORRECTION

PATENT NO. : 6,183,240 B1 
DATED : February 6, 2001
INVENTOR(S) : Klaus Döbbeling et al.

It is certified that error appears in the above-identified patent and that said Letters Patent is hereby corrected as shown below:

Column 6,
Lines 3-5 and 6-8, delete “, preferably between -20º and +20º, in particular preferably at approximately 0º”.

Signed and Sealed this

First Day of April, 2003

JAMES E. ROGAN
*Director of the United States Patent and Trademark Office*